US011387564B2

(12) United States Patent
Kim et al.

(10) Patent No.: US 11,387,564 B2
(45) Date of Patent: Jul. 12, 2022

(54) CAVITY FILTER AND ANTENNA MODULE INCLUDING THE SAME

(71) Applicant: Samsung Electronics Co., Ltd., Suwon-si (KR)

(72) Inventors: Dongjoo Kim, Suwon-si (KR); Bonmin Koo, Suwon-si (KR); Jonghwa Kim, Suwon-si (KR); Seungtae Ko, Suwon-si (KR); Youngju Lee, Suwon-si (KR); Jongwook Zeong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 175 days.

(21) Appl. No.: 16/747,887

(22) Filed: Jan. 21, 2020

(65) Prior Publication Data

US 2020/0235484 A1 Jul. 23, 2020

(30) Foreign Application Priority Data

Jan. 22, 2019 (KR) ..... 10-2019-0008412

(51) Int. Cl.
*H01Q 15/00* (2006.01)
*H01P 1/207* (2006.01)
*H01P 1/205* (2006.01)

(52) U.S. Cl.
CPC ..... *H01Q 15/0006* (2013.01); *H01P 1/207* (2013.01); *H01P 1/2053* (2013.01)

(58) Field of Classification Search
CPC .... H01Q 15/0006; H01P 1/2053; H01P 1/207
See application file for complete search history.

(56) References Cited

U.S. PATENT DOCUMENTS 4,342,972 A 8/1982 Nishikawa et al.
5,418,509 A * 5/1995 Piirainen ..... H01P 1/205 333/203

(Continued)

FOREIGN PATENT DOCUMENTS

JP S5851601 A 3/1983
JP 2012-204844 A 10/2012

(Continued)

OTHER PUBLICATIONS

International Search Report dated May 1, 2020, issued in an International Application No. PCT/KR2020/001114.

(Continued)

*Primary Examiner* — Stephen E. Jones
*Assistant Examiner* — Kimberly E Glenn
(74) *Attorney, Agent, or Firm* — Jefferson IP Law, LLP

(57) ABSTRACT

The present disclosure relates to a communication method and system for converging a 5th-Generation (5G) communication system for supporting higher data rates beyond a 4th-Generation (4G) system with a technology for Internet of Things (IoT). The present disclosure may be applied to intelligent services based on the 5G communication technology and the IoT-related technology, such as smart home, smart building, smart city, smart car, connected car, health care, digital education, smart retail, security and safety services. A cavity filter is provided. The cavity filter includes a plate of the cavity filter and including a feeder part for supplying an electrical signal, a housing forming an exterior of the cavity filter and coupled to the plate to form a shielded space inside the cavity filter, and a metal structure having a first end coupled to an inside of the housing and a second end that extends toward the feeder part and resonates to filter frequencies in the shielded space.

20 Claims, 8 Drawing Sheets

(56) References Cited

U.S. PATENT DOCUMENTS

| | | | | |
|---|---|---|---|---|
| 6,919,782 | B2 * | 7/2005 | Sauder | H01P 1/2053 333/202 |
| 2009/0146763 | A1 | 6/2009 | Hershtig | |
| 2009/0153271 | A1 | 6/2009 | Park et al. | |
| 2012/0098613 | A1 * | 4/2012 | Han | H03J 1/0008 333/17.1 |
| 2013/0130519 | A1 | 5/2013 | Kokkinos | |
| 2015/0244049 | A1 | 8/2015 | Vangala | |
| 2015/0333386 | A1 | 11/2015 | Kaneda et al. | |

FOREIGN PATENT DOCUMENTS

| | | | |
|---|---|---|---|
| KR | 10-2011-0041919 | A | 4/2011 |
| KR | 10-2018-0080443 | A | 7/2018 |

OTHER PUBLICATIONS

European Search Report dated Jan. 4, 2022, issued in European Patent Application No. 20745545.2.

* cited by examiner

CAVITY FILTER AND ANTENNA MODULE INCLUDING THE SAME

CROSS-REFERENCE TO RELATED APPLICATION(S)

This application is based on and claims priority under 35 U.S.C. § 119(a) of a Korean patent application number 10-2019-0008412, filed on Jan. 22, 2019, in the Korean Intellectual Property Office, the disclosure of which is incorporated by reference herein in its entirety.

BACKGROUND

1. Field

The disclosure relates to a cavity filter of a surface mount device (SMD) type mountable on a printed circuit board (PCB).

2. Description of Related Art

To meet the demand for wireless data traffic having increased since deployment of 4G communication systems, efforts have been made to develop an improved 5G or pre-5G communication system. Therefore, the 5G or pre-5G communication system is also called a 'Beyond 4G Network' or a 'Post LTE System'. The 5G communication system is considered to be implemented in higher frequency (mmWave) bands, e.g., 60 GHz bands, so as to accomplish higher data rates. To decrease propagation loss of the radio waves and increase the transmission distance, the beamforming, massive multiple-input multiple-output (MIMO), Full Dimensional MIMO (FD-MIMO), array antenna, an analog beam forming, large scale antenna techniques are discussed in 5G communication systems. In addition, in 5G communication systems, development for system network improvement is under way based on advanced small cells, cloud Radio Access Networks (RANs), ultra-dense networks, device-to-device (D2D) communication, wireless backhaul, moving network, cooperative communication, Coordinated Multi-Points (CoMP), reception-end interference cancellation and the like. In the 5G system, Hybrid FSK and QAM Modulation (FQAM) and sliding window superposition coding (SWSC) as an advanced coding modulation (ACM), and filter bank multi carrier (FBMC), non-orthogonal multiple access (NOMA), and sparse code multiple access (SCMA) as an advanced access technology have been developed.

The Internet, which is a human centered connectivity network where humans generate and consume information, is now evolving to the Internet of Things (IoT) where distributed entities, such as things, exchange and process information without human intervention. The Internet of Everything (IoE), which is a combination of the IoT technology and the Big Data processing technology through connection with a cloud server, has emerged. As technology elements, such as "sensing technology", "wired/wireless communication and network infrastructure", "service interface technology", and "Security technology" have been demanded for IoT implementation, a sensor network, a Machine-to-Machine (M2M) communication, Machine Type Communication (MTC), and so forth have been recently researched. Such an IoT environment may provide intelligent Internet technology services that create a new value to human life by collecting and analyzing data generated among connected things. IoT may be applied to a variety of fields including smart home, smart building, smart city, smart car or connected cars, smart grid, health care, smart appliances and advanced medical services through convergence and combination between existing Information Technology (IT) and various industrial applications.

In line with this, various attempts have been made to apply 5G communication systems to IoT networks. For example, technologies such as a sensor network, Machine Type Communication (MTC), and Machine-to-Machine (M2M) communication may be implemented by beamforming, MIMO, and array antennas. Application of a cloud Radio Access Network (RAN) as the above-described Big Data processing technology may also be considered to be as an example of convergence between the 5G technology and the IoT technology.

In a 5G mobile communication system, a plurality of cavity filters may be included in one antenna module. That is, the assemblability of cavity filters may affect the performance of an antenna module.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide a cavity filter structure that can improve the performance of an antenna module.

Additional aspects will be set forth in part in the description which follows and, in part, will be apparent from the description, or may be learned by practice of the presented embodiments.

In accordance with an aspect of the disclosure, a cavity filter is provided. The cavity filter includes a plate of the cavity filter and including a feeder part for supplying an electrical signal, a housing forming an exterior of the cavity filter and coupled to the plate to form a shielded space inside the cavity filter, and a metal structure having a first end coupled to an inside of the housing and a second end that extends toward the feeder part and resonates to filter frequencies in the shielded space.

In accordance with another aspect of the disclosure, a cavity filter is provided. The cavity filter includes a plate of the cavity filter and including a feeder part for supplying an electrical signal, a housing forming an exterior of the cavity filter and coupled to the plate to form a shielded space inside the cavity filter, and a metal structure having a first coupled to an inside of the housing and a second end that extends toward the feeder part, wherein a conductive region is formed on a surface of the plate facing the metal structure to generate a resonance and filter frequencies of a signal.

In accordance with yet another aspect of the disclosure, an antenna module including a cavity filter configured to filter frequencies is provided. The cavity filter includes a plate including a feeder part for supplying an electrical signal, a housing forming an exterior of the cavity filter and coupled to the plate to form a shielded space inside the cavity filter, and a metal structure having a first end coupled to an inside of the housing and a second end extends toward the feeder part and resonates to filter the frequencies in the shielded space.

In accordance with yet another aspect of the disclosure, an antenna module including a cavity filter configured to filter frequencies is provided. The cavity filter includes a plate including a feeder part for supplying an electrical signal, a housing forming an exterior of the cavity filter and coupled to the plate to form a shielded space inside the cavity filter, and a metal structure having a first end coupled to an inside of the housing and a second end extends toward the feeder part to filter frequencies in the shielded space, wherein a conductive region is formed on a surface of the plate facing the metal structure to generate a resonance and filter frequencies of a signal.

According to an embodiment of the disclosure, the ability to assemble and mass produce cavity filters can be improved. In addition, the characteristics of a cavity filter can be easily controlled.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features and advantages of certain embodiments of the disclosure will be more apparent from the following description, taken in conjunction with the accompanying drawings, in which.

Throughout the drawings, like reference numerals will be understood to refer to like parts, components, and structures.

DETAILED DESCRIPTION

Figure 1:
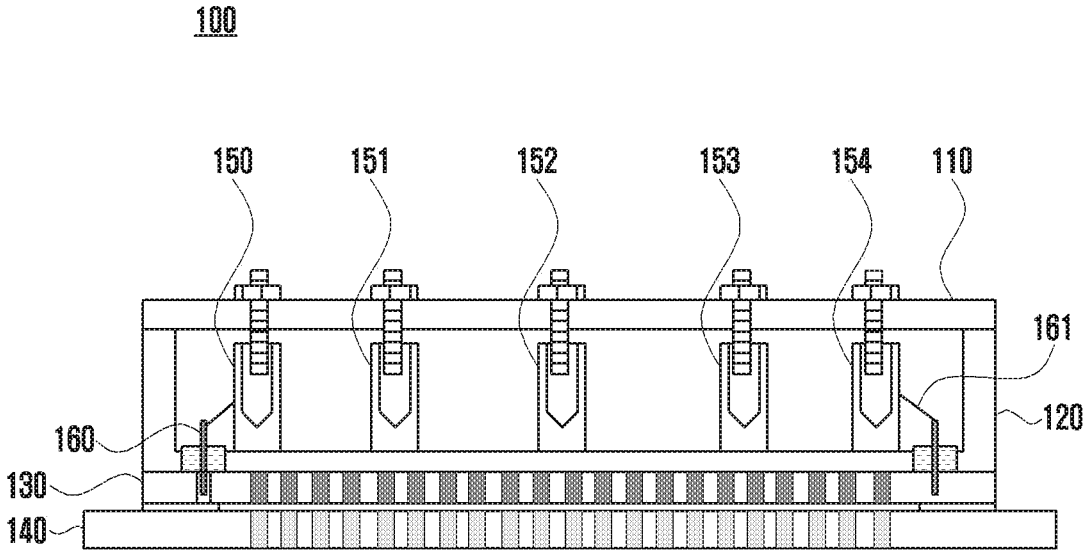
FIG. 1 is a view showing a cavity filter structure according to the related art.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

In the drawings, some elements are exaggerated, omitted, or only outlined in brief, and thus may be not drawn to scale. The same or similar reference symbols are used throughout the drawings to refer to the same or like parts.

The aspects, features, and advantages of certain embodiments of the disclosure will be more apparent from the following detailed description taken in conjunction with the accompanying drawings. The description of the various embodiments is to be construed as exemplary only and does not describe every possible instance of the disclosure. It should be apparent to those skilled in the art that the following description of various embodiments of the disclosure is provided for illustrative purposes only and not for the purpose of limiting the disclosure as defined by the appended claims and their equivalents. The same reference symbols are used throughout the description to refer to the same parts.

Meanwhile, it is known to those skilled in the art that blocks of a flowchart (or sequence diagram) and a combination of flowcharts may be represented and executed by computer program instructions. These computer program instructions may be loaded on a processor of a general purpose computer, special purpose computer, or programmable data processing equipment. When the loaded program instructions are executed by the processor, the instructions create a means for carrying out functions described in the flowchart. As the computer program instructions may be stored in a computer readable or computer usable memory that is usable in a computer or a programmable data processing equipment to implement functionality in a particular manner, the instructions stored in a computer readable or computer usable memory are also possible to create articles of manufacture containing instruction means that carry out functions described in the flowchart block(s). As the computer program instructions may be loaded on a computer or other programmable data processing equipment, the instructions, that perform a computer or other programmable data processing equipment by creating a computer-implemented process on a computer or other programmable data processing equipment, may carry out operations of functions described in the flowchart block(s).

Each block of a flowchart may correspond to a module, a segment or a code containing one or more executable instructions for implementing a specified logical function, or to a part thereof. In some cases, functions described by blocks may be executed in an order different from the listed order. For example, two blocks listed in sequence may be executed at the same time or executed in reverse order.

In the description, the word "unit", "module", or the like may refer to a software component or hardware component such as a field-programmable gate array (FPGA) or application specific integrated circuit (ASIC) and "unit" or the like is capable of carrying out a function or an operation. However, "unit" or the like is not limited to hardware or software. A unit or the like may be configured so as to reside in an addressable storage medium or to drive one or more processors. Units or the like may refer to software components, object-oriented software components, class components, task components, processes, functions, attributes, procedures, subroutines, program code segments, drivers, firmware, microcode, circuits, data, databases, data structures, tables, arrays, or variables. A function provided by components and units may be a combination of smaller number of components and units, and it may be separated into additional components and units. Components and units may be configured to drive a device or one or more central processing units (CPUs) in a secure multimedia card. In one embodiment, a unit or module may include one or more processors.

FIG. 1 is a view showing a cavity filter structure according to the related art.

Referring to FIG. 1, a cavity filter 100 may include a cover 110 constituting one surface of the cavity filter 100, and a housing 120 coupled to the cover 110 to form the exterior of the cavity filter 100. In various embodiments, a closed space may be formed inside the cavity filter 100 by the cover 110 and the housing 120.

In one embodiment, the cavity filter 100 may include at least one metal structure 150, 151, 152, 153, or 154 to determine filter characteristics. In various embodiments, the characteristics (e.g., capacitance value) of the cavity filter may be determined based on the sizes and locations of the metal structures 150, 151, 152, 153, and 154. The at least one metal structure 150, 151, 152, 153, or 154 may be coupled to the cover 110 through bolts.

In one embodiment, the cavity filter 100 may be coupled to one surface of a printed circuit board (PCB) 140. In various embodiments, a separate auxiliary PCB 130 may be required to surface mount radio frequency (RF) pins 160 and 161 on the PCB 140.

In one embodiment, two holes may be formed in one surface of the housing 120 to accommodate the RF pins 160 and 161. In various embodiments, the characteristics (e.g., inductance value) of the cavity filter may be determined by electrically connecting and controlling the RF pins 160 and 161 to the at least one metal structure 150, 151, 152, 153, or 154.

In one embodiment, the holes of the housing 120 through which the RF pins 160 and 161 pass may include an auxiliary material for fixing the RF pins 160 and 161. In various embodiments, this auxiliary material may be deformed by high temperature heat during the processing of the cavity filter 100.

Figure 2A:
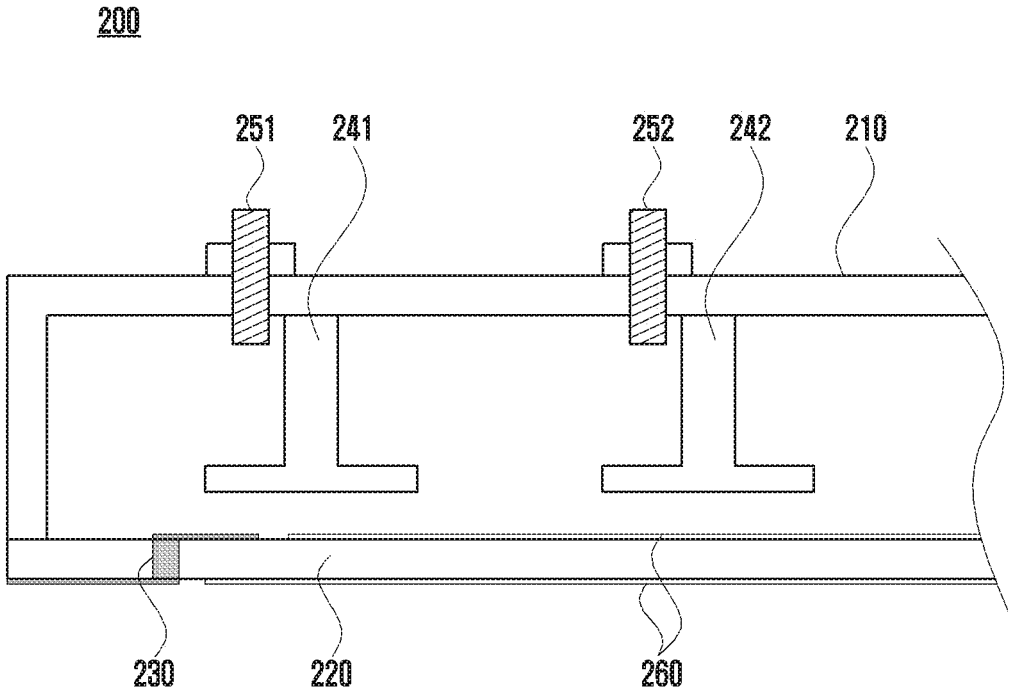
FIG. 2A is a side view of a cavity filter according to an embodiment of the disclosure.

FIG. 2A is a side view of a cavity filter according to an embodiment of the disclosure.

Referring to FIG. 2A, in one embodiment, a cavity filter 200 may include a plate 220 constituting one surface of the cavity filter 200, and a housing 210 that constitutes the exterior of the cavity filter and is coupled to the plate 220 to form a shielded space inside the cavity filter. In various embodiments, the plate 220 may be made of a nonmetallic material. For example, the plate 220 may be a PCB.

In one embodiment, at least one metal structure 241 or 242 may be disposed on one surface of the housing 210. In various embodiments, the at least one metal structure 241 or 242 may be spaced apart by a preset distance from the plate 220.

In one embodiment, a feeder part 230 may be included in the plate 220. In various embodiments, when an electrical signal is supplied to the feeder part 230, a capacitance component may be generated between the feeder part 230 and the metal structure 241. In one embodiment, the capacitance component generated between the feeder part 230 and the metal structure 241 may be determined based on the spacing between the feeder part 230 and the metal structure 241 or the area of an overlapping region between the feeder part 230 and the metal structure 241.

In one embodiment, at least one control bolt 251 or 252 may be disposed in one surface of the housing 210. In various embodiments, the control bolts 251 and 252 may be arranged to correspond respectively to the metal structures and may control magnetic fields generated through the metal structures by changing the lengths of the corresponding metal structures. For example, the first control bolt 251 corresponding to the first metal structure 241 may control the value of the inductance due to the first metal structure 241, and the second control bolt 252 corresponding to the second metal structure 242 may control the value of the inductance due to the second metal structure 242.

In one embodiment, the plate 220 may be coupled to one surface of a PCB. For example, the cavity filter 200 may be surface mounted on the PCB through the plate 220. In various embodiments, a conductive pattern 260 may be formed on the plate 220 to transmit an electrical signal (e.g., RF signal) to the PCB.

Figure 2B:
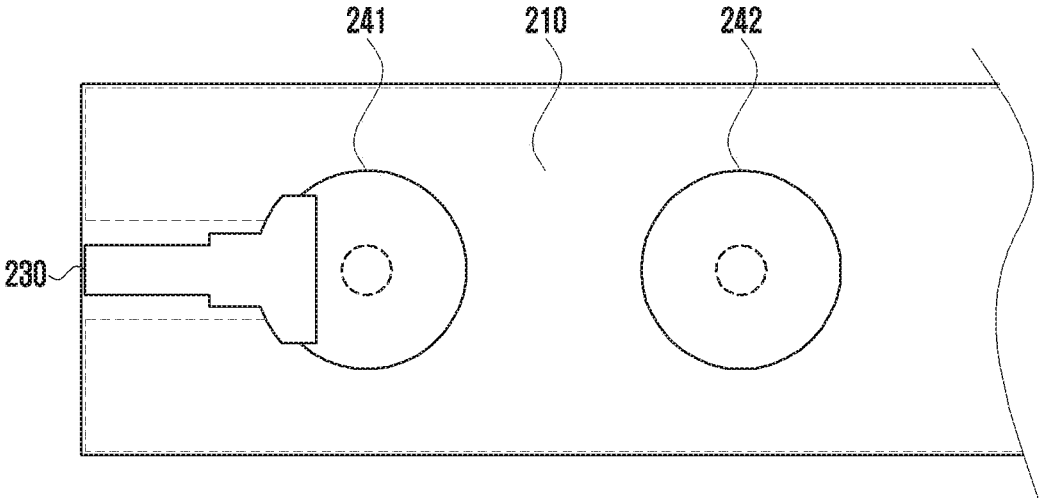
FIG. 2B is a top view of the cavity filter according to an embodiment of the disclosure.

FIG. 2B is a top view of the cavity filter according to an embodiment of the disclosure.

Referring to FIG. 2B, the cavity filter may correspond to the case where the cavity filter of FIG. 2A is viewed from above. More specifically, FIG. 2B shows the cavity filter seen transparently from above.

In one embodiment, the first metal structure 241 and the second metal structure 242 may be disposed on one surface of the housing 210 of the cavity filter. In various embodiments, the feeder part 230 may be spaced apart by a preset distance from the bottom surface of the first metal structure 241.

In one embodiment, the first metal structure 241 and the feeder part 230 may have an overlapping region when viewed from above the cavity filter. In various embodiments, the capacitance component of the cavity filter may be determined based on the area of the overlapping region between the first metal structure 241 and the feeder part 230 or the distance between the first metal structure 241 and the feeder part 230.

Figure 2C:
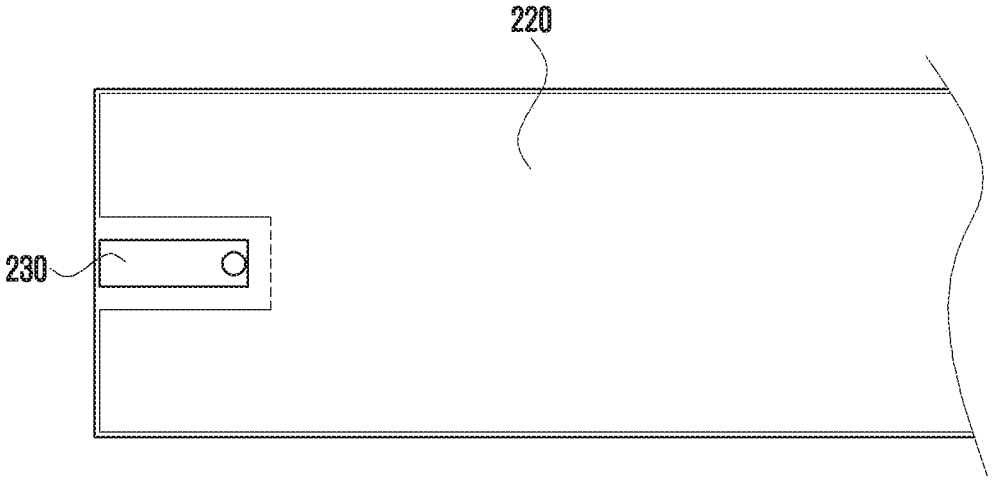
FIG. 2C is a bottom view of the cavity filter according to an embodiment of the disclosure.

FIG. 2C is a bottom view of the cavity filter according to an embodiment of the disclosure.

Referring to FIG. 2C, in one embodiment, the feeder part 230 may be disposed at a side portion of the plate 220. In various embodiments, the side portion of the plate 220 may be coupled to the PCB. In one embodiment, the feeder part 230 may receive an electrical signal from the PCB coupled with the side portion of the plate 220.

Meanwhile, FIGS. 2A, 2B, and 2C illustrate one embodiment of the disclosure. Hence, the scope of the disclosure should not be limited to the structure shown in FIGS. 2A, 2B, and 2C.

Figure 3:
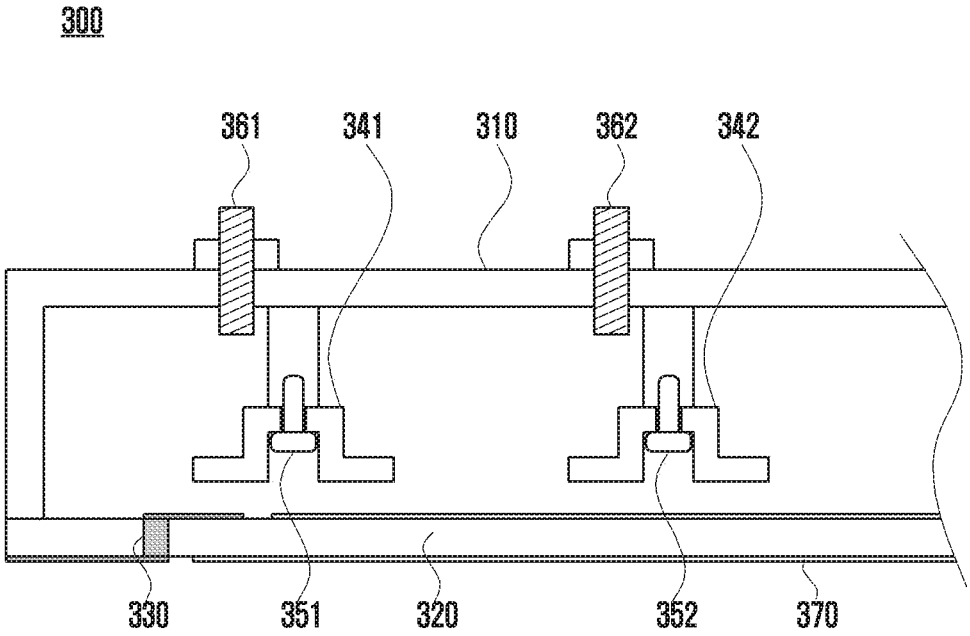
FIG. 3 is a side view of a cavity filter according to an embodiment of the disclosure.

FIG. 3 is a side view of a cavity filter according to an embodiment of the disclosure.

Referring to FIG. 3, in one embodiment, the cavity filter 300 may include a plate 320 constituting one surface of the cavity filter 300, and a housing 310 that constitutes the exterior of the cavity filter and is coupled to the plate 320 to form a shielded space inside the cavity filter. In various embodiments, the plate 320 may be made of a nonmetallic material. For example, the plate 320 may be a PCB.

In one embodiment, at least one metal structure 341 or 342 may be disposed on one surface of the housing 310. In various embodiments, the at least one metal structure 341 or 342 may be coupled to one surface of the housing 310 through bolts 351 and 352. For example, the first metal structure 341 may be coupled to the housing 310 through the first bolt 351, and the second metal structure 342 may be coupled to the housing 310 through the second bolt 352. In one embodiment, the at least one metal structure 341 or 342 may be spaced apart by a preset distance from the plate 320.

In one embodiment, a feeder part 330 may be included in the plate 320. In various embodiments, when an electrical signal is supplied to the feeder part 330, a capacitance component may be generated between the feeder part 330 and the metal structure 341. In one embodiment, the capacitance component generated between the feeder part 330 and the metal structure 341 may be determined based on the spacing between the feeder part 330 and the metal structure 341 or the area of an overlapping region between the feeder part 330 and the metal structure 341.

In one embodiment, at least one control bolt 361 or 362 may be disposed in one surface of the housing 310. In various embodiments, the control bolts 361 and 362 may be arranged to correspond respectively to the metal structures and may control magnetic fields generated through the metal structures by changing the lengths of the corresponding metal structures. For example, the first control bolt 361 corresponding to the first metal structure 341 may control the value of the inductance due to the first metal structure 341, and the second control bolt 362 corresponding to the second metal structure 342 may control the value of the inductance due to the second metal structure 342.

In one embodiment, the plate 320 may be coupled to one surface of a PCB. For example, the cavity filter 300 may be surface mounted on the PCB through the plate 320. In various embodiments, a conductive pattern 370 may be formed on the plate 320 to transmit an electrical signal (e.g., RF signal) to the PCB.

Figure 4A:
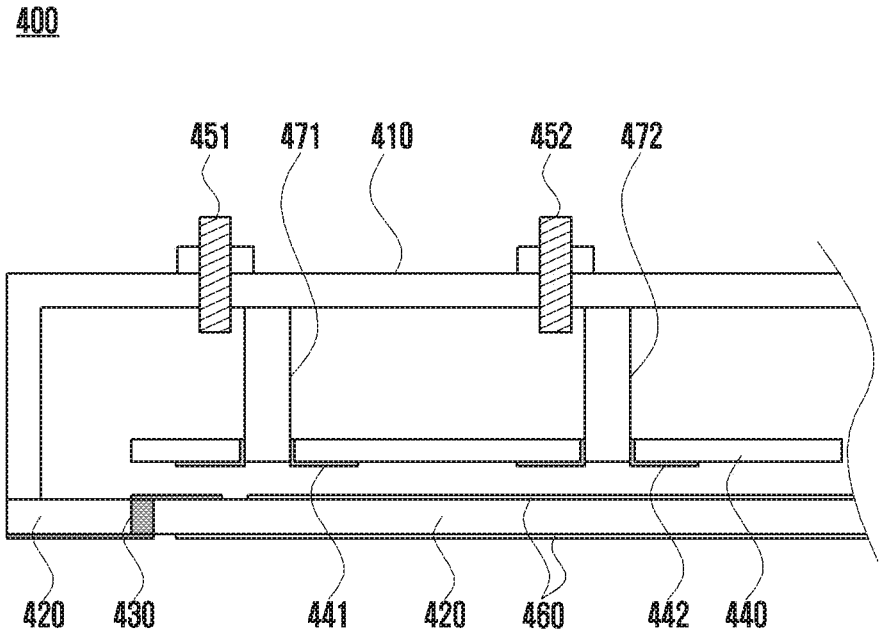
FIG. 4A is a side view of a cavity filter according to an embodiment of the disclosure.

FIG. 4A is a side view of a cavity filter according to an embodiment of the disclosure.

Referring to FIG. 4A, in one embodiment, the cavity filter 400 may include a plate 420 constituting one surface of the cavity filter 400, and a housing 410 that constitutes the exterior of the cavity filter and is coupled to the plate 420 to form a shielded space inside the cavity filter. In various embodiments, the plate 420 may be made of a nonmetallic material. For example, the plate 420 may be a PCB.

In one embodiment, at least one metal structure 471 or 472 may be disposed on one surface of the housing 410. In various embodiments the at least one metal structure 471 or 472 may be coupled to a PCB 440 having a function of a resonator. In one embodiment, the PCB 440 may be spaced apart by a preset distance from the plate 420.

In one embodiment, in the PCB 440, a first metal region 441 may be disposed at a portion corresponding to the first metal structure 471, and a second metal region 442 may be disposed at a portion corresponding to the second metal structure 472. The PCB 440 will be described in more detail later with reference to FIG. 4B.

In one embodiment, a feeder part 430 may be included in the plate 420. In various embodiments, when an electrical signal is supplied to the feeder part 430, a capacitance component may be generated between the feeder part 430 and the PCB 440. In one embodiment, the capacitance component generated between the feeder part 430 and the PCB 440 may be determined based on the spacing between the feeder part 430 and the PCB 440 or the area of an overlapping region between the feeder part 430 and the PCB 440.

In one embodiment, at least one control bolt 451 or 452 may be disposed in one surface of the housing 410. In various embodiments, the control bolts may be arranged to correspond respectively to the metal structures and may control magnetic fields generated through the metal structures by changing the lengths of the corresponding metal structures. For example, the first control bolt 451 corresponding to the first metal structure 471 may control the value of the inductance due to the first metal structure 471, and the second control bolt 452 corresponding to the second metal structure 472 may control the value of the inductance due to the second metal structure 472.

In one embodiment, the plate 420 may be coupled to one surface of a PCB. For example, the cavity filter 400 may be surface mounted on the PCB through the plate 420. In various embodiments, a conductive pattern 460 may be formed on the plate 420 to transmit an electrical signal (e.g., RF signal) to the PCB.

Figure 4B:
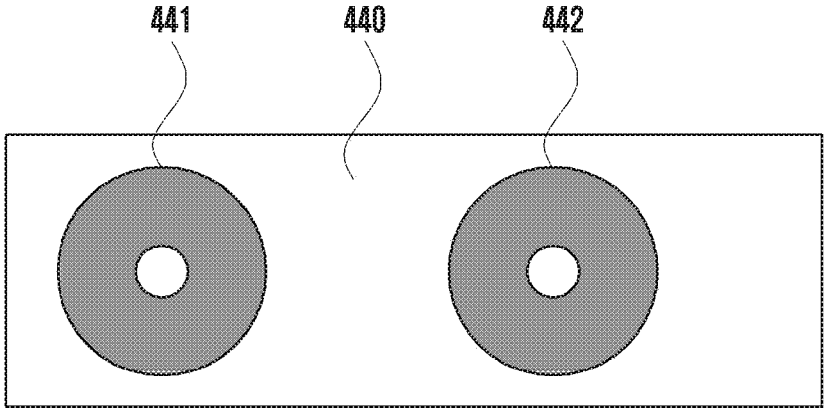
FIG. 4B illustrates a printed circuit board (PCB) used for a cavity filter according to an embodiment of the disclosure.

FIG. 4B illustrates a PCB used for a cavity filter according to an embodiment of the disclosure.

Referring to FIG. 4B, in one embodiment, in a PCB 440 coupled to the metal structures 471 and 472 formed inside the cavity filter, a first metal region 441 and a second metal region 442 may be formed at positions corresponding to the metal structures. In various embodiments, the first metal structure 471 may be electrically connected to the first metal region 441, and the second metal structure 472 may be electrically connected to the second metal region 442.

In one embodiment, the PCB 440 including the first metal region 441 and the second metal region 442 may be coupled with the first metal structure 471 and the second metal structure 472 through soldering or the like. In FIG. 4B, only the case where the first metal region 441 and the second metal region 442 are formed in a circular shape is illustrated, but the scope of the disclosure should not be limited thereto. For example, the first metal region 441 and the metal region 442 may have various shapes such as a rectangle and a triangle.

Figure 5:
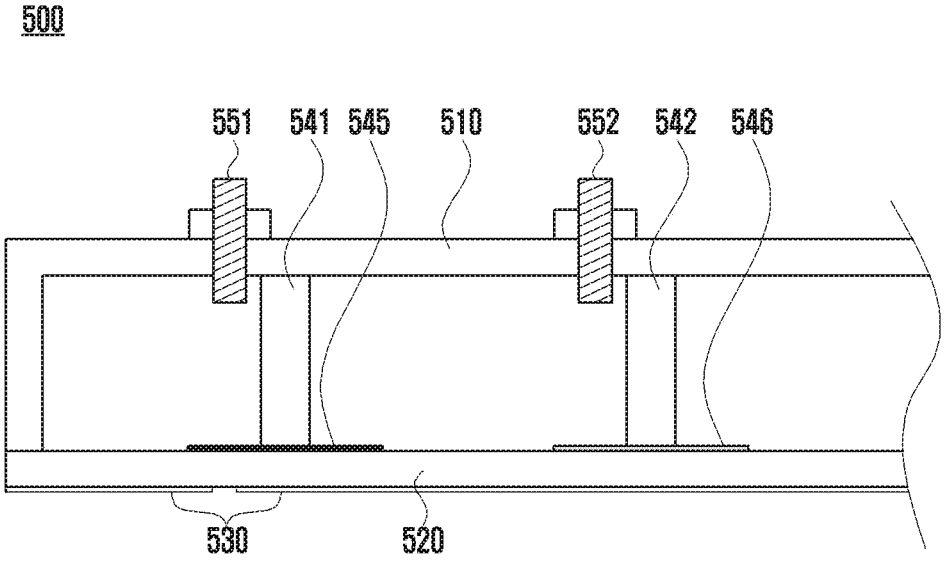
FIG. 5 is a side view of a cavity filter according to an embodiment of the disclosure.

FIG. 5 is a side view of a cavity filter according to an embodiment of the disclosure.

Referring to FIG. 5, in one embodiment, the cavity filter 500 may include a plate 520 constituting one surface of the cavity filter 500, and a housing 510 that constitutes the exterior of the cavity filter and is coupled to the plate 520 to form a shielded space inside the cavity filter. The plate 520 may be made of a nonmetallic material. For example, the plate 520 may be a PCB.

In one embodiment, at least one metal structure 541 or 542 may be disposed on one surface of the housing 510. In various embodiments, one surface of each metal structure 541 or 542 may contact one surface of the plate 520. For example, the first metal structure 541 may be electrically coupled to a first metal region 545 formed on one surface of the plate 520, and the second metal structure 542 may be electrically coupled to a second metal region 546 formed on the same surface of the plate 520.

In one embodiment, the other surface of the plate 520 (e.g., the rear surface of the surface where the first metal region 545 and the second metal region 546 are disposed) may be coupled to one surface of a PCB. In various embodiments, a conductive pattern 530 may be formed on the other surface of the plate 520 to transmit an electrical signal (e.g., RF signal) to the PCB.

In one embodiment, when an electrical signal is supplied to the conductive pattern 530, capacitance components may be generated between the conductive pattern 530 and the metal regions 545 and 546. The capacitance components generated between the conductive pattern 530 and the metal regions 545 and 546 may be determined based on the thickness of the plate 520 or the area of the overlapping region between the conductive pattern and the metal regions 545 and 546.

In one embodiment, at least one control bolt 551 or 552 may be disposed in one surface of the housing 510. In various embodiments, the control bolts may be arranged to correspond respectively to the metal structures and may control magnetic fields generated through the metal structures by changing the lengths of the corresponding metal structures. For example, the first control bolt 551 corresponding to the first metal structure 541 may control the value of the inductance due to the first metal structure 541, and the second control bolt 552 corresponding to the second metal structure 542 may control the value of the inductance due to the second metal structure 542.

In one embodiment, a cavity filter may include: a plate constituting one surface of the cavity filter and including a feeder part for supplying an electrical signal in one surface; a housing constituting the exterior of the cavity filter and coupled to the plate to form a shielded space inside the cavity filter; and a metal structure whose one end is coupled to the inside of the housing and the other end extends toward the feeder part and resonates to filter frequencies in the shielded space.

In one embodiment, the other end of the metal structure may be spaced apart by a preset distance from the feeder part. The resonance frequency of the cavity filter may be determined based on the spacing between the other end of the metal structure and the feeder part and the length of the metal structure.

In one embodiment, the other end of the metal structure may be spaced apart by a preset distance from the feeder part. The capacitance component of the cavity filter may be determined based on the area of a region where the other end of the metal structure and the feeder part face each other or the spacing between the other end of the metal structure and the feeder part. The inductance component of the cavity filter may be determined based on the length of the metal structure.

In one embodiment, the cavity filter may comprise a layer made of a non-metallic material and may further include a layer coupled to the other end of the metal structure. The other end of the metal structure may be spaced apart by a preset distance from the feeder part. A metal region made of a metallic material may be formed on one surface of the layer facing the plate.

In one embodiment, the capacitance component of the cavity filter may be determined based on the area of a region of the feeder part that overlaps the metal region or the spacing between the layer and the feeder part.

In one embodiment, the cavity filter may further include a control bolt disposed in one surface of the housing to control the inductance component of the cavity filter.

In one embodiment, a metal region made of a metallic material may be formed on one surface of the plate facing the metal structure, and the feeder part may be disposed on the other surface of the plate.

In one embodiment, one end of the metal structure may be electrically coupled to the metal region.

In one embodiment, the capacitance component of the cavity filter may be determined based on the area of a region of the feeder part that overlaps the metal region or the thickness of the plate.

In one embodiment, a cavity filter may include: a plate constituting one surface of the cavity filter and including a feeder part for supplying an electrical signal in one surface; a housing constituting the exterior of the cavity filter and coupled to the plate to form a shielded space inside the cavity filter; and a metal structure whose one end is coupled to the inside of the housing and the other end extends toward the feeder part to filter frequencies in the shielded space, wherein a metal region made of a metallic material may be formed on one surface of the plate facing the metal structure and a resonance may be caused by the metal region formed on one surface of the plate to filter frequencies.

In one embodiment, an antenna module may include a cavity filter. The cavity filter may include: a plate constituting one surface of the cavity filter and including a feeder part for supplying an electrical signal in one surface; a housing constituting the exterior of the cavity filter and coupled to the plate to form a shielded space inside the cavity filter; and a metal structure whose one end is coupled to the inside of the housing and the other end extends toward the feeder part and resonates to filter frequencies in the shielded space.

In one embodiment, the other end of the metal structure may be spaced apart by a preset distance from the feeder part. The resonance frequency of the cavity filter may be determined based on the spacing between the other end of the metal structure and the feeder part and the length of the metal structure.

In one embodiment, the other end of the metal structure may be spaced apart by a preset distance from the feeder part. The capacitance component of the cavity filter may be determined based on the area of a region where the other end of the metal structure and the feeder part face each other or the spacing between the other end of the metal structure and the feeder part. The inductance component of the cavity filter may be determined based on the length of the metal structure.

In one embodiment, the cavity filter may comprise a layer made of a non-metallic material and may further include a layer coupled to the other end of the metal structure. The other end of the metal structure may be spaced apart by a preset distance from the feeder part. A metal region made of a metallic material may be formed on one surface of the layer facing the plate.

In one embodiment, the capacitance component of the cavity filter may be determined based on the area of a region of the feeder part that overlaps the metal region or the spacing between the layer and the feeder part.

In one embodiment, the cavity filter may further include a control bolt disposed in one surface of the housing to control the inductance component of the cavity filter.

In one embodiment, a metal region made of a metallic material may be formed on one surface of the plate facing the metal structure, and the feeder part may be disposed on the other surface of the plate.

In one embodiment, one end of the metal structure may be electrically coupled to the metal region.

In one embodiment, the capacitance component of the cavity filter may be determined based on the area of a region of the feeder part that overlaps the metal region or the thickness of the plate.

In one embodiment, an antenna module may include a cavity filter. The cavity filter may include: a plate constituting one surface of the cavity filter and including a feeder part for supplying an electrical signal in one surface; a housing constituting the exterior of the cavity filter and coupled to the plate to form a shielded space inside the cavity filter; and a metal structure whose one end is coupled to the inside of the housing and the other end extends toward the feeder part to filter frequencies in the shielded space, wherein a metal region made of a metallic material may be formed on one surface of the plate facing the metal structure and a resonance may be caused by the metal region formed on one surface of the plate to filter frequencies.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A cavity filter comprising:

a plate comprising a feeder part supplying an electrical signal;

a housing forming an exterior of the cavity filter and coupled to the plate, the housing and the plate forming a shielded space inside the cavity filter; and a metal structure comprising:

a first end coupled to an inside of the housing, and a second end extending toward the feeder part and resonating to filter frequencies in the shielded space, wherein a resonant frequency of the cavity filter is determined based on a spacing between the second end of the metal structure and the feeder part and a length of the metal structure.

2. The cavity filter of claim 1, wherein the second end of the metal structure is spaced apart from the feeder part by a preset distance.

3. The cavity filter of claim 1, wherein the second end of the metal structure is spaced apart from the feeder part by a preset distance, wherein a capacitance of the cavity filter is determined based on at least one of an area of a region where the second end of the metal structure and the feeder part face each other or the spacing between the second end of the metal structure and the feeder part, and wherein an inductance of the cavity filter is determined based on the length of the metal structure.

4. The cavity filter of claim 1, further comprising:

a layer comprising a non-metallic material fixed to the second end of the metal structure and including a conductive region on a surface facing the plate, wherein the second end of metal structure is spaced apart from the feeder part by a preset distance.

5. The cavity filter of claim 4, wherein a capacitance of the cavity filter is determined based on at least one of a spacing between the layer and the feeder part or an area of a region of the feeder part that overlaps the conductive region and the metal structure.

6. The cavity filter of claim 1, further comprising a control bolt disposed in one surface of the housing to control an inductance of the cavity filter.

7. The cavity filter of claim 1, wherein a conductive region is formed on a first surface of the plate facing the metal structure, and wherein the feeder part is disposed on a second surface of the plate opposite to the first surface of the plate.

8. The cavity filter of claim 7, wherein the second end of the metal structure is electrically coupled to the conductive region.

9. The cavity filter of claim 7, wherein a capacitance of the cavity filter is determined based on at least one of an area of the feeder part that overlaps the conductive region or a thickness of the plate.

10. A cavity filter comprising:

a plate comprising a feeder part supplying an electrical signal;

a housing forming an exterior of the cavity filter and coupled to the plate, the housing and the plate forming a shielded space inside the cavity filter; and a metal structure comprising:

a first end coupled to an inside of the housing, and a second end extending toward the feeder part, wherein a conductive region is formed on a surface of the plate facing the metal structure to generate a resonance and filter frequencies of a signal, and wherein a resonant frequency of the cavity filter is determined based on a spacing between the second end of the metal structure and the feeder part and a length of the metal structure.

11. An antenna comprising:

a cavity filter comprising:

a plate comprising a feeder part supplying an electrical signal, a housing forming an exterior of the cavity filter and coupled to the plate, the housing and the plate forming a shielded space inside the cavity filter, and a metal structure comprising:

a first end coupled to an inside of the housing, and a second end extending toward the feeder part and resonating to filter the frequencies in the shielded space, wherein a resonant frequency of the cavity filter is determined based on a spacing between the second end of the metal structure and the feeder part and a length of the metal structure.

12. The antenna of claim 11, wherein the second end of the metal structure is spaced apart by a preset distance from the feeder part.

13. The antenna of claim 11, wherein the second end of the metal structure is spaced apart by a preset distance from the feeder part, wherein a capacitance of the cavity filter is determined based on at least one of an area of a region where the second end of the metal structure and the feeder part face each other or the spacing between the second end of the metal structure and the feeder part, and wherein an inductance of the cavity filter is determined based on the length of the metal structure.

14. The antenna of claim 11, wherein the cavity filter further comprises:

a layer comprising a non-metallic material fixed to the second end of the metal structure and including a conductive region on a surface facing the plate, wherein the second end of metal structure being spaced apart by a preset distance.

15. The antenna of claim 14, wherein a capacitance of the cavity filter is determined based on at least one of a spacing between the layer and the feeder part or an area of a region of the feeder part that overlaps the conductive region and the metal structure.

16. The antenna of claim 11, wherein the cavity filter further comprises a control bolt disposed in one surface of the housing to control an inductance of the cavity filter.

17. The antenna of claim 11, wherein a conductive region is formed on a first surface of the plate facing the metal structure, and wherein the feeder part is disposed on a second surface of the plate opposite to the first surface of the plate.

18. The antenna of claim 17, wherein the second end of the metal structure is electrically coupled to the conductive region.

19. The antenna of claim 17, wherein a capacitance of the cavity filter is determined based on at least one of an area of the feeder part that overlaps the conductive region or a thickness of the plate.

20. An antenna comprising:

a cavity filter comprising:

a plate comprising a feeder part supplying an electrical signal, a housing forming an exterior of the cavity filter and coupled to the plate, the housing and the plate forming a shielded space inside the cavity filter, and a metal structure comprising:

a first end coupled to an inside of the housing, and a second end extending toward the feeder part, wherein a conductive region is formed on a surface of the plate facing the metal structure to generate a resonance and filter frequencies of a signal, and wherein a resonant frequency of the cavity filter is determined based on a spacing between the second end of the metal structure and the feeder part and a length of the metal structure.

* * * * *